US011538425B2

(12) United States Patent
Inoue et al.

(10) Patent No.: US 11,538,425 B2
(45) Date of Patent: Dec. 27, 2022

(54) DISPLAY DEVICE

(71) Applicant: SHARP KABUSHIKI KAISHA, Sakai (JP)

(72) Inventors: Naoto Inoue, Sakai (JP); Naoko Goto, Sakai (JP); Tomoyuki Nara, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/367,237

(22) Filed: Jul. 2, 2021

(65) Prior Publication Data

US 2022/0020336 A1 Jan. 20, 2022

Related U.S. Application Data

(60) Provisional application No. 63/054,204, filed on Jul. 20, 2020.

(51) Int. Cl.
*G09G 3/34* (2006.01)

(52) U.S. Cl.
CPC ..... *G09G 3/3426* (2013.01); *G09G 2320/064* (2013.01)

(58) Field of Classification Search
CPC ..... G09G 3/3426; G09G 2320/064
See application file for complete search history.

(56) References Cited

U.S. PATENT DOCUMENTS

2006/0125774 A1* 6/2006 Nishigaki ..... G09G 3/342 345/102
2008/0238858 A1* 10/2008 Seong ..... G09G 3/3426 345/102
2011/0012937 A1* 1/2011 Onishi ..... G09G 3/3426 345/102
2015/0206484 A1* 7/2015 Gotoh ..... G09G 3/3406 345/102

FOREIGN PATENT DOCUMENTS

JP 2013-045740 A 3/2013
JP 2014-026006 A 2/2014

* cited by examiner

*Primary Examiner* — Towfiq Elahi
(74) *Attorney, Agent, or Firm* — ScienBiziP, P.C.

(57) ABSTRACT

A display device includes: light-emitting elements in a backlight divided into a plurality of areas, the light-emitting elements being arranged in such a manner as to correspond to the plurality of areas; and a drive unit configured to drive the light-emitting elements in the plurality of areas by time division based on an input image every prescribed period of time, the drive unit turning on all the light-emitting elements in the plurality of areas in a partial period of the prescribed period of time and driving those light-emitting elements in at least one of the plurality of areas based on the input image in a remaining period of the prescribed period of time.

6 Claims, 4 Drawing Sheets

DISPLAY DEVICE

CROSS-REFERENCE TO RELATED APPLICATION

The present application claims priority Provisional Application No. 63/054,204, the content to which is hereby incorporated by reference into this application.

BACKGROUND OF THE INVENTION

1. Field of the Invention

The disclosure relates to display devices.

2. Description of the Related Art

Local dimming is a technique for controlling an LCD (liquid crystal display) that includes a backlight including light sources divided into areas, whereby the luminance of those light sources in each area is controlled in every frame period on the basis of image data for that display region of the liquid crystal panel, the image data corresponding to the area. The local dimming that involves the division into an extremely large number may be carried out by passive driving.

In passive driving, for example, those LEDs in each four of 16 areas are connected collectively to a different channel of an LED driver (LED Driver, LED drive circuit) for time division driving (time-sharing of an LED driver). This particular scheme can simplify wiring and reduce the number of channels of the LED driver.

Take an example shown in FIG. 4 where there are provided LEDs divided into 4 times 4 (=16) areas that are driven by 4 time divisions. Referring to FIG. 4, the cathode terminals of each four LEDs are connected to a different channel of the LED driver. Voltage is applied to the anode terminals of the LEDs by time division.

This separate driving of the LEDs for each quarter of the 16 areas (=4 areas) enables the driving of the backlight divided into 16 areas with an LED driver that has a quarter as many channels as the areas (=4 channels).

Japanese Unexamined Patent Application Publication, Tokukai, No. 2014-26006 discloses a display device including a plurality of light-emitting bodies divided into some groups for turn-on/off operations wherein the groups of light-emitting bodies are sequentially turned on and off by dividing the cycle of the vertical synchronization signal into a number of periods that is equal to the number of the groups.

Meanwhile, Japanese Unexamined Patent Application Publication, Tokukai, No. 2013-45740 discloses variably controlling at least either the duty ratio or the current level of a PWM (pulse width modulation) signal for each switch in such a manner that the luminance of the LED Hock connected to a switch corresponding to each divisional area is suited to the image displayed in the divisional area.

SUMMARY OF THE. INVENTION

This technique entails a problem that the backlight is not so bright because the duty ratio of the PWM signal available for the LEDs in each area is no more than a quarter (25%) in order to use the LED driver by 4 time divisions.

The root cause of the problem is that each single channel of the LED driver is driven by time division. To drive individual LEDs with an LED driver having fewer channels than the areas, time-sharing of the LED driver is essential.

Specifically, when the LEDs are driven by n time divisions, the LED driver needs one-n-th times as many channels as the areas, and the duty ratio of the PWM signal available for the LEDs in each area in a single cycle is likewise one-n-th at maximum. In other words, the LEDs are turned on for a shorter duration than when the duty ratio is 100%. The backlight is therefore darker when driven by n time divisions than in typical cases where the LEDs are driven by a method that does not involve any time division.

The disclosure, in an aspect thereof, has an object to enable a backlight to brightly light up when the light-emitting elements are driven by time division.

(1) The disclosure, in an embodiment thereof, is directed to a display device including: light-emitting elements in a backlight divided into a plurality of areas, the light-emitting elements being arranged in such a manner as to correspond to the plurality of areas; and a drive unit configured to drive the light-emitting elements in the plurality of areas by time division based on an input image every prescribed period of time, the drive unit turning on all the light-emitting elements in the plurality of areas in a partial period of the prescribed period of time and driving those light-emitting elements in at least one of the plurality of areas based on the input image in a remaining period of the prescribed period of time.

(2) in another embodiment of the disclosure, the display device having structure set forth in (1) above is configured such that the drive unit changes a duration of the partial period of the prescribed time.

(3) in yet another embodiment of the disclosure, the display device having structure set forth in (2) above is configured such that the drive unit changes the duration of the partial period of the prescribed time in accordance with a prescribed condition.

(4) In still another embodiment of the disclosure, the display device having structure set forth in (2) or (3) above is configured such that the drive unit changes the duration of the partial period in accordance with a screen luminance setting of the display device.

(5) In yet still another embodiment of the disclosure, the display device having any of structures set forth in (2) to (4) above is configured such that the drive unit changes the duration of the partial period in accordance with an application used on the display device.

(6) in a further embodiment of the disclosure, the display device having any of structures set forth in (2) to (5) above is configured such that the drive unit changes the duration of the partial period in accordance with a power supply status of the display device.

The disclosure, in an aspect thereof, enables a backlight to brightly light up when the light-emitting elements are driven by time division.

DETAILED DESCRIPTION OF THE INVENTION

Embodiment 1

The following will describe Embodiment 1 of the disclosure in detail.

Structure of Display Device 1

Figure 1:
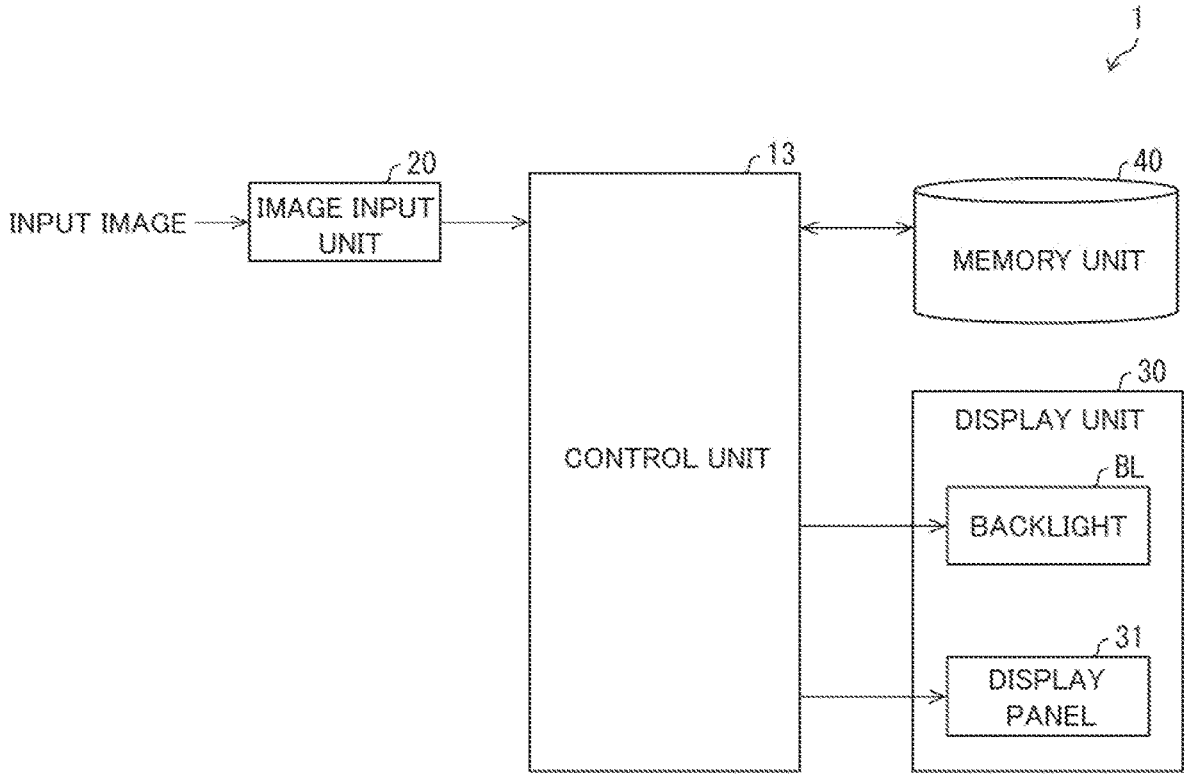
FIG. 1 is a functional block diagram of major components of a display device in accordance with Embodiment 1 of the disclosure.

FIG. 1 is a functional block diagram of major components of a display device 1 in accordance with Embodiment 1. The display device 1 includes a control unit 13, an image input unit 20, a display unit 30, and a memory unit 40. The image input unit 20 acquires data for images to be displayed on the display device 1 (display unit 30) ("image data"). The image represented by the image data acquired by the image input unit 20 may be referred to as the input image.

The display unit 30 is, for example, a liquid crystal display device. The display unit 30 includes a backlight BL and a display panel 31. The display panel 31 is, for example, a liquid crystal panel. The display panel 31 includes a matrix of pixels (display elements) for "shutter controlling" the light coming from the backlight BL. The display panel 31 may include a color filter (not shown).

The backlight BL projects light (e.g., white light) onto the display panel 31. The backlight BL is disposed on the backside of the display panel 31 (opposite from the display screen) so as to overlap the display panel 31. The backlight BL includes a plurality of LEDs 11 (light-emitting elements).

The backlight BL may include a light guide plate (not shown). The light emitted by the LEDs 11 in the backlight BL onto the display panel 31 forms images on the display screen (display region) of the display panel 31 through the plurality of pixels. In other words, an image can be displayed on the display region.

The control unit 13 collectively controls various units in the display device 1. The control unit 13 determines the light emission intensity of the LEDs 11 especially on the basis of the input image. The control unit 13 also executes a correction process of correcting the image data on the basis of the determined light emission intensity. The control unit 13 corrects the image data, for example, so as to achieve the same luminance as the luminance represented by the image data. The control unit 13 outputs signals in accordance with the corrected image data to a drive circuit (not shown) in the display panel 31. The drive circuit in the display panel 31 outputs signals for controlling the optical transmittance of the pixels in the display panel 31 (voltage signals) to the display panel 31. An image is thus displayed on the display panel 31.

Figure 2:
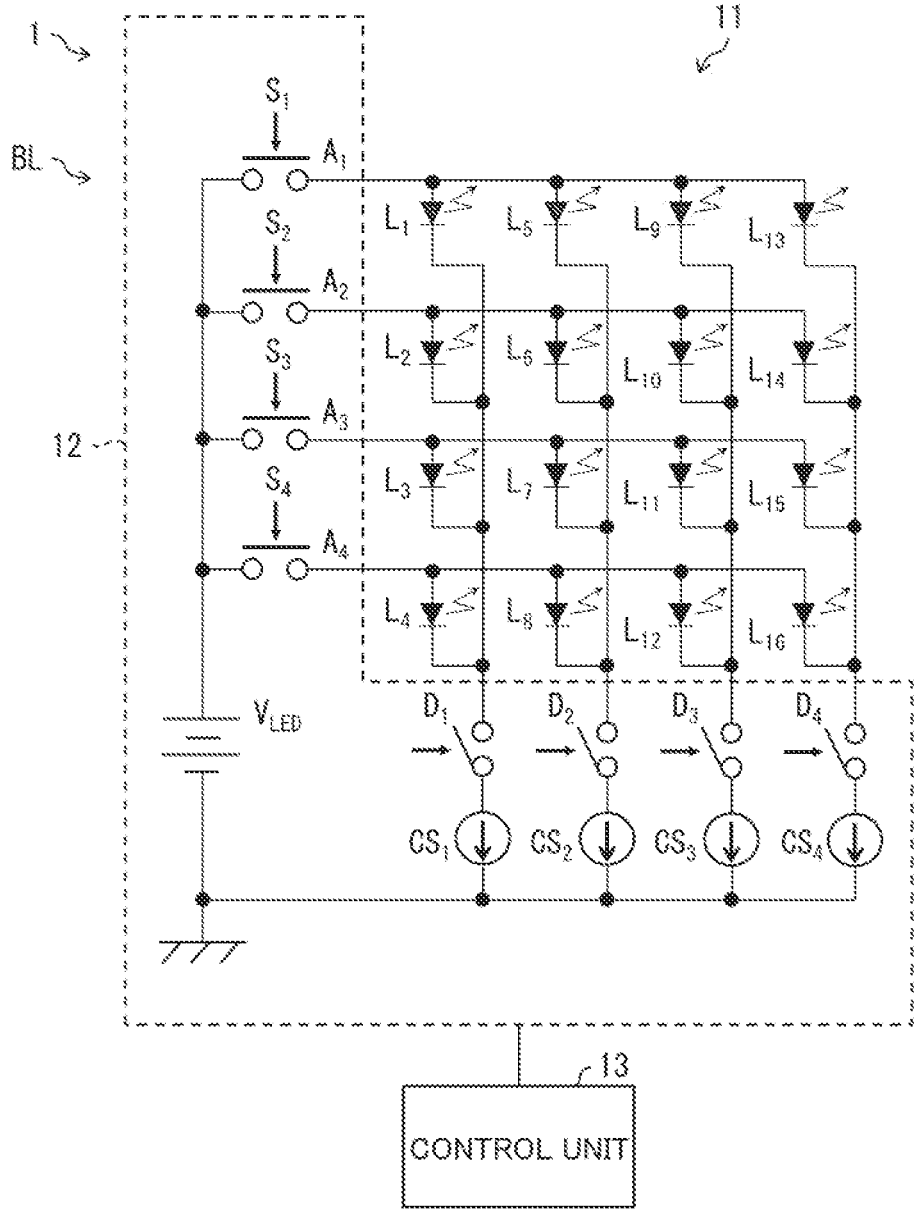
FIG. 2 is a diagram of a structure of a backlight.

FIG. 2 is a diagram of a structure of the backlight BL. Referring to FIG. 2, the backlight BL includes the LEDs 11 and a drive circuit (drive unit) 12. In each of the areas of the backlight BL into which the backlight BL is divided, the LEDs 11 are arranged in 4 rows (plurality of rows) and 4 columns (plurality of columns). The LEDs 11 include 16 LEDs L1 to L16.

The drive circuit 12 sequentially drive the LEDs 11 in at least one row in each of the prescribed periods into which a frame period is divided. A frame period is a period of time in which the display device 1 displays one frame of image.

The control unit 13 includes, for example, a microcomputer for changing settings for the drive circuit 12. The control unit 13, in particularly, determines the light emission intensity of the LEDs 11 for each area on the basis of the input image. The drive circuit 12 drives the LEDs 11 in accordance with the light emission intensity determined by the control unit 13.

Referring to FIG. 2, the drive circuit 12 includes a voltage source VLED, switches S1 to S4, drivers D1 to D4, and current sources CS1 to CS4. The voltage source VLED is a power supply for applying a DC voltage to the LEDs 11. The switches S1 to S4 are connected to the anode terminals of the LEDs so as to control the ON/OFF of the voltage application for each row of LEDs. The drivers D1 to D4 are connected to the cathode terminals of the LEDs so as to control the ON/OFF of the voltage application for each column of LEDs. The current sources CS1 to CS4 are connected between the drivers D1 to D4 and the grounding terminal so as to control electric currents in the channels of the drivers. The current sources CS1 to CS4 can individually control current levels.

The backlight BL, Which implements local dimming by extremely large number of divisions, employs passive driving illustrated in FIG. 2 to decrease the number of drive channels of the LED driver.

FIG. 2 shows a structure in which there are provided 4 rows times 4 columns (=16) light source areas on an LED substrate. Referring to FIG. 2, the cathode terminals of the LEDs in a column (L1 to L4) are collected and connected to a channel for the first driver D1. Likewise, the cathode terminals of the LEDs in another column (L5 to L8) are collected and connected to a channel for the driver D2, the cathode terminals of the LEDs in yet another column (L9 to L12) are collected and connected to a channel for the driver D3, and the cathode terminals of the LEDs in still another column (L13 to L16) are collected and connected to a channel for the driver D4. Meanwhile, the anode terminals of the LEDs in each row (A1 to A4) are collected and connected to the switches S1 to S4.

This configuration includes 16 areas, wherein the drivers D have a quarter as many drive channels as the 16 areas (e.g., 4 drive channels) and 4 anode-connected switches S.

Brief Description of Operation of Drive Circuit 12

In the present embodiment, the drive circuit 12 drives the LEDs 11 in a plurality of areas by time division on the basis of the input image every prescribed period of time. To this end, the drive circuit 12 turns on all the LEDs 11 in the plurality of areas in a part of a prescribed time. In the remaining part of the prescribed time, the drive circuit 12 drives the LEDs 11 in at least one area on the basis of the input image. The drive circuit 12 drives the LEDs 11 by PWM dimming in the present embodiment. PWM dimming controls the luminance of the LED 11 by supplying a constant current to the LED 11 and varying the ON duration of the LED 11.

The drive circuit 12 cyclically repeats the turn-on/off control of the switches S1 to S4 every prescribed period of time (e.g., once in every frame period). Since the cathode terminals of four of the LEDs 11 are connected to a driver channel of the drive circuit 12, and the anode terminals of the four LEDs 11 are connected to the switches S1 to S4 that are turned on/off by time division, the four LEDs 11 can be sequentially driven. This particular scheme enables the LEDs 11 in the 16 areas to be driven using a quarter as many driver channels as the areas.

Detailed Description of Operation of Drive Circuit 12

Figure 3:
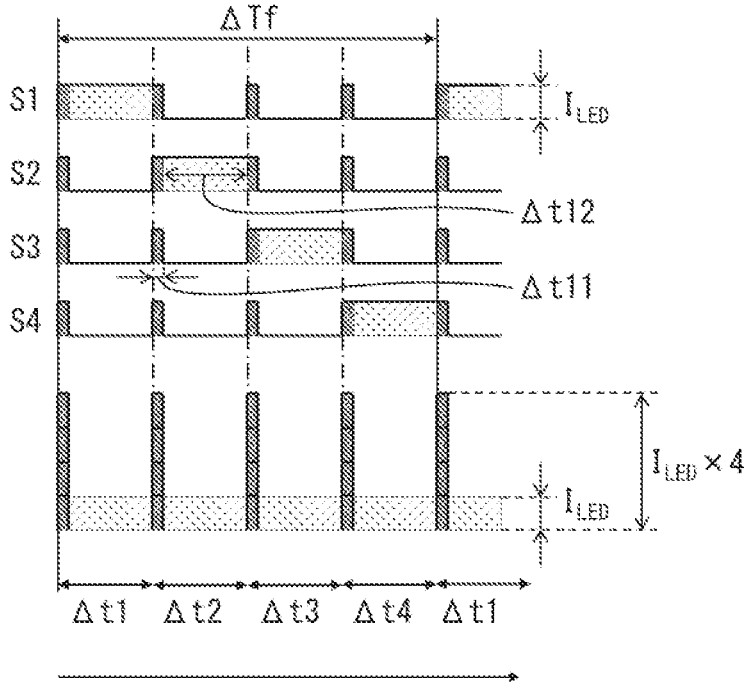
FIG. 3 is a diagram showing an exemplary timing chart for a drive circuit.
Figure 4:
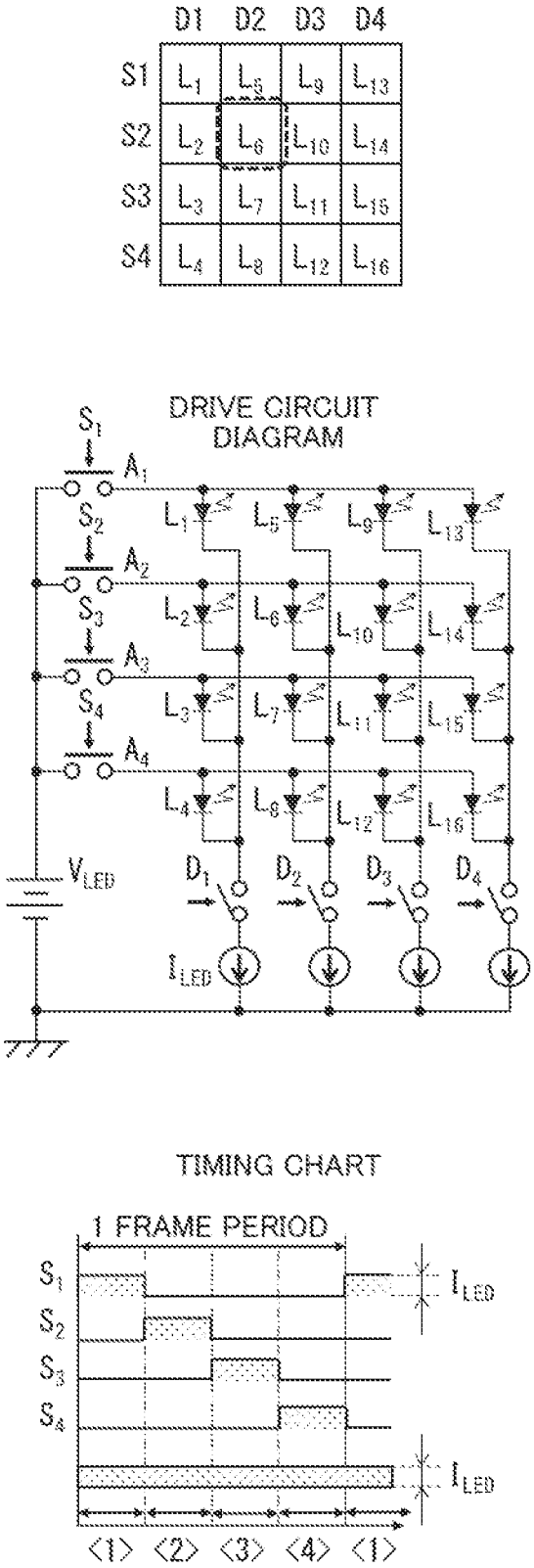
FIG. 4 is a diagram of exemplary conventional driving of LEDs by 4 time divisions.

FIG. 3 is a diagram showing a timing chart for the drive circuit 12. The timing chart in FIG. 3, focusing on one of the drivers D1 to D4, illustrates the turn-on control of the LEDs connected to that driver. In the figure, each frame period $\Delta Tf$ is divided into four prescribed times $\Delta t1$ to $\Delta t4$. The prescribed time Δt1 is allocated to the driving of the LEDs L1, L5, 19, and L13 connected to the switch S1. The prescribed time Δt2 is allocated to the driving of the LEDs L2, L6, L10, and L14 connected to the switch S2. The prescribed time Δt3 is allocated to the driving of the LEDs L3, L7, L10, and L15 connected to the switch S3. The prescribed time Δt4 is allocated to the driving of the LEDs L4, L8, L12, and L16 connected to the switch S4.

Each prescribed time Δt1 to Δt4 includes an offset period Δt11. In the offset period, the backlight is turned on uniformly across the display unit 30. The period Δt11 is, for example, 5% of the prescribed time Δt1. The remaining period, or the non-offset period, Δt12 in each prescribed time Δt1 to Δt4 accounts for, for example, 95% of the prescribed time Δt1. The offset period Δt11 is not necessarily 5% of the prescribed time and may account for more or less than 5% of the prescribed time.

The drive circuit 12 turns on the LEDs L1 to L16 at a maximum luminance irrespective of the input image in the offset period Δt11 in the prescribed times Δt1 to Δt4. In contrast, in the remaining period Δt12 of the prescribed times, the drive circuit 12 drives the LEDs L1 to L16 in accordance with the input image.

Specifically, the drive circuit 12 turns on all the switches S1 to S4 in the period Δt11 in the prescribed time Δt1. All the LEDs L1 to L16 are thus turned on at a maximum luminance in the period Δt11. The current flow in the LEDs 11 in this situation is denoted by ILED.

Meanwhile, the drive circuit 12 turns on only the switch S1 and turns off the other switches S2 to S4 in the remaining period Δt12 of the prescribed time Δt1. The LEDs L1, L5, L9, and L13 are thus PWM-driven by the respective drivers D1 to D4 in the period Δt12. In other words, in the period Δt12, the LEDs L1, L5, L9, and L13 are driven in accordance with the light emission intensity determined in accordance with the input image. FIG. 3 shows a maximum current flow in the LEDs 11 also for the period Δt12. The current flow in the period Δt12 is hence equal to ILED.

Likewise, the drive circuit 12 turns on all the switches S1 to S4 in the partial period Δt11 of the prescribed time Δt2. All the LEDs L1 to L16 are thus turned on in the period Δt11.

Meanwhile, the drive circuit 12 turns on only the switch S2 and turns off the other switches S1, S3, and S4 in the remaining period Δt12 of the prescribed time Δt2. The LEDs L2, L6, L10, and L14 are thus PWM-driven by the respective drivers D1 to D4 in the period Δt12. In other words, in the period Δt12, the LEDs L2, L6, L10, and L14 are thus driven in accordance with the light emission intensity determined in accordance with the input image.

Likewise, the drive circuit 12 turns on all the switches S1 to S4 in the partial period Δt11 of the prescribed time Δt3. All the LEDs L1 to L16 are thus turned on in the period Δt11.

Meanwhile, the drive circuit 12 turns on only the switch S3 and turns off the other switches S1, S2, and S4 in the remaining period Δt12 of the prescribed time Δt3. The LEDs L3, L7, L11, and L15 are thus PWM-driven by the respective drivers D1 to D4 in the period Δt12. The drive circuit 12 PWM-drives the LEDs L3, L7, L11, and L15 in accordance with the light emission intensity determined by the control unit 13

Likewise, the drive circuit 12 turns on all the switches S1 to S4 in the partial period Δt11 of the prescribed time Δt4. All the LEDs L1 to L16 are thus turned on in the period Δt11.

Meanwhile, the drive circuit 12 turns on only the switch S4 and turns off the other switches S1 to S3 in the remaining period Δt12 of the prescribed time Δt4. The LEDs L4, L8, L12, and L16 are thus PWM-driven by the respective drivers D1 to D4 in the period Δt12. The drive circuit 12 PWM-drives the LEDs L4, L8, L12, and L16 in accordance with the light emission intensity determined by the control unit 13.

As described here, the drive circuit 12 drives the LEDs 11 in four (in other words, one or more) areas in the remaining period Δt12 of each prescribed time Δt1 to Δt4.

The partial period Δt11 and the remaining period Δt12 may be transposed in each prescribed time Δt1 to Δt4.

In example shown in FIG. 3, When the offset period Δt11 is 5% of the prescribed time, the tour switches S1 to S4 are turned on in the offset period Δt11, and therefore luminance as much as 20%, or four times 5%, is guaranteed for offset. In addition, in the remaining period Δt12 of the prescribed times, the drivers D1 to D4 PWM-drive the LEDs 11 in 95% of the prescribed time. This particular scheme achieves a maximum luminance of 115%, or a sum of 20% and 95%, in each area. As demonstrated here, the luminance that corresponds to the period allocated as an offset is added to the luminance in each area in the present embodiment. The luminance of each LED 11 hence ranges from 20% to 115%.

The luminance of 100% in this context corresponds to an average luminance of the LEDs 11 when the offset period Δt11 is 0% so that the LEDs 11 can be turned on at a maximum luminance by ordinary passive driving as a whole. This driving scheme of the present embodiment turns on the LEDs 11 for a quarter of the frame period ΔTf. The actual average luminance is hence one fourth.

The driving scheme described so far in the present embodiment can achieve a luminance of more than 100%. In other words, the driving scheme described in the present embodiment can achieve a luminance that exceeds the luminance achieved by ordinary passive driving.

The offset is not necessarily 5% of the prescribed time. For instance, the offset may be 10% of the prescribed time, in which case the offset period guarantees a luminance of 40%, or four times 10%, and the maximum luminance in the remaining period is 90%. The maximum luminance in each area is therefore equal to 130%, or a sum of 40% and 90%. Under these conditions, the luminance of the LEDs L1 to L16 ranges from 40% to 130%. The drive circuit 12 may change the duration of the partial period Δt11 of the prescribed times Δt1 to Δt4 as described here.

The bottom of FIG. 3 shows electric current flowing through a driver. Since current flows to all the four LEDs 11 connected to each driver in the offset period Δt11 in the prescribed times Δt1 to Δt4, a current of 4 times ILED flows through the driver. In contrast, in the remaining period Δt12 of the prescribed times Δt1 to Δt4, since current flows to one of the four LEDs 11 connected to each driver, a current of ILED flows.

Embodiment 2

The following will describe another embodiment of the disclosure. For convenience of description, members that have the same function as members described in the preceding embodiment will be indicated by the same reference numerals, and description thereof is not repeated.

The present embodiment differs from Embodiment 1 above in the lighting control operations carried out by the drive circuit 12 on the backlight BL. The drive circuit 12, in the present embodiment, changes the duration of the offset period in the prescribed time for each area in accordance with prescribed conditions, for example, the usage of the display device 1.

The control unit 13, in the present embodiment, makes settings to change the duration of the offset period in the prescribed time for each area in accordance with prescribed conditions.

Examples of the prescribed conditions and examples of the setting operation performed by the control unit 13 are described next. The prescribed conditions include, for example, screen luminance settings of the display device 1, the types of applications used on the display device 1, and the power supply status of the display device.

Assume, as a first example, that the user have manipulated to change the luminance level of the screen of the mobile device, which is the display device 1. In response to the user manipulation, the control unit 13 changes the offset period settings in accordance with the luminance level. For instance, there are screen luminance levels 1 to 10 with level 1 being the darkest and level 10 being the brightest. For instance, the control unit 13 sets the offset ratio to 5% for brightness levels 1 to 6, 10% for brightness levels 7 to 9, and 15% for brightness level 10. The control unit 13 increases the duration of the offset period (increases the ratio thereof) when a higher brightness level is required by the user. The drive circuit 12 adjusts the method of driving the LEDs 11 in accordance with the screen luminance of the display device 1. Specifically, the drive circuit 12 changes the duration of the offset period in accordance with the screen luminance settings of the display device 1.

This particular scheme enables selecting a suitable offset ratio in accordance with the screen luminance settings of the display device 1.

The screen luminance settings of the display device 1 may be changed by, for example, the user. As an alternative example, the display device 1 may include an external light sensor, so that the screen luminance settings can be controlled to produce brighter images for brighter external light in accordance to a detection result provided by the external light sensor.

As a second example, assume that the user is to use an application on the mobile device. In this situation, the control unit 13 changes the offset period settings in accordance with the screen luminance needed for the application.

For instance, the control unit 13 sets the offset ratio to 5% for a word processing application, 10% for a still image photo, and 15% for movie or a like moving image. Word processing will not require a high screen luminance. Still image photos have a broad brightness dynamic range and hence will require a relatively high screen luminance. The movies and like moving images include bright and dark scenes, as well as bright and dark zones in single frames, and hence will require a higher screen luminance. The control unit 13 increases the duration of the offset period (increases the ratio thereof) for applications that require a higher screen luminance. The drive circuit 12 adjusts the method of driving the LEDs 11 in accordance with the application used on the display device 1. Specifically, the drive circuit 12 changes the duration of the offset period in accordance with the application used on the display device 1.

This particular scheme enables selecting a suitable offset ratio in accordance with the application used on the display device 1.

As a third example, the control unit 13 changes the offset period settings in accordance with the power supply status of the mobile device. For instance, the control unit 13 sets the offset ratio to 5% when there is not left much battery power, 10% when there is left much battery available, and 15% when the mobile device is connected to an AC adapter. The control unit 13 increases the duration of the offset period (increases the ratio thereof) with an increase in available power supply because the longer the offset period, the higher the maximum luminance in each area, and hence the more power the display device 1 consumes. The drive circuit 12 adjusts the method of driving the LEDs 11 in accordance with the power supply status of the display device 1. Specifically, the drive circuit 12 changes the duration of the offset period in accordance with the power supply status of the display device 1. This particular scheme enables selecting a suitable offset ratio in accordance with the power supply status of the display device 1.

This operation outlined here of the drive circuit 12 enables selecting a suitable offset ratio in accordance with the screen luminance, the application used, and the power supply status.

Software Implementation

The control unit 13 in the display device 1 may be implemented by logic circuits (hardware) fabricated, for example, in the form of integrated circuits (IC chips) and may be implemented by software.

In the latter form of implementation, the display device 1 includes a computer that executes instructions from programs or software by which various functions are provided. This computer includes among others at least one processor (control device) and at least one storage medium containing the programs in a computer-readable format. The processor in the computer then retrieves and runs the programs contained in the storage medium, thereby achieving the object of the disclosure. The processor may be, for example, a CPU (central processing unit). The storage medium may be a "non-transitory, tangible medium" such as a ROM (readwily memory), a tape, a disc/disk, a card, a semiconductor memory, or programmable logic circuitry. The display device 1 may further include, for example, a RAM (random access memory) for loading the programs. The programs may be supplied to the computer via any transmission medium (e.g., over a communications network or by broadcasting waves) that can transmit the programs. The disclosure, in an aspect thereof, encompasses data signals on a carrier wave that are generated during electronic transmission of the programs.

The display device of any aspect of the disclosure may be implemented on a computer, in which case the computer is controlled so as to serve as various units (software elements) of the display device. The disclosure, in an aspect thereof, hence encompasses a display device control program causing the computer to implement the display device and also encompasses a computer-readable storage medium containing the display device control program.

The disclosure is not limited to the description of the embodiments above and may be altered within the scope of the claims. Embodiments based on a proper combination of technical means disclosed in different embodiments are encompassed in the technical scope of the disclosure. Furthermore, new technological features can be created by combining different technical means disclosed in the embodiments.

What is claimed is:

1. A display device comprising:

light-emitting elements in a backlight divided into a plurality of areas, the light-emitting elements being arranged in a plurality of rows and a plurality of columns in such a manner as to correspond to the plurality of areas;

a plurality of switches configured to control ON/OFF of voltage application for each row of the light-emitting elements; and a drive unit configured to drive the light-emitting elements in the plurality of areas by time division based on an input image every prescribed period of time by sequentially driving the light emitting-elements in at least one row in each of the prescribed periods into which a frame period is divided, the drive unit turning on all the light-emitting elements in the plurality of areas by turning on all of the plurality of switches in a partial period of the prescribed period of time and driving those light-emitting elements in at least one of the plurality of areas based on the input image by turning on a part of the plurality of switches and turning off the other part of the plurality of switches in a remaining period of the prescribed period of time.

2. The display device according to claim 1, wherein the drive unit changes a duration of the partial period of the prescribed period of time.

3. The display device according to claim 2, wherein the drive unit changes the duration of the partial period of the prescribed period of time in accordance with a prescribed condition.

4. The display device according to claim 2, wherein the drive unit changes the duration of the partial period in accordance with a screen luminance setting of the display device.

5. The display device according to claim 2, wherein the drive unit changes the duration of the partial period in accordance with an application used on the display device.

6. The display device according to claim 2, wherein the drive unit changes the duration of the partial period in accordance with a power supply status of the display device.

* * * * *